US012410563B2

(12) United States Patent
Chepets

(10) Patent No.: US 12,410,563 B2
(45) Date of Patent: Sep. 9, 2025

(54) ROAD SURFACE PANELS SYSTEMS

(71) Applicant: Igor Chepets, Brooklyn, NY (US)

(72) Inventor: Igor Chepets, Brooklyn, NY (US)

( * ) Notice: Subject to any disclaimer, the term of this patent is extended or adjusted under 35 U.S.C. 154(b) by 966 days.

(21) Appl. No.: 17/530,256

(22) Filed: Nov. 18, 2021

(65) Prior Publication Data

US 2023/0151558 A1 May 18, 2023

(51) Int. Cl.
*E01C 5/00* (2006.01)

(52) U.S. Cl.
CPC ..... *E01C 5/005* (2013.01); *E01C 2201/06* (2013.01); *E01C 2201/20* (2013.01)

(58) Field of Classification Search
CPC ... E01C 5/005; E01C 2201/06; E01C 2201/20
USPC ..... 404/34–46
See application file for complete search history.

(56) References Cited

U.S. PATENT DOCUMENTS 1,683 A * 7/1840 DeLisle ..... E01C 5/14 404/46
6,269,605 B1 * 8/2001 Geiger ..... E01C 5/06 52/603
2001/0033770 A1 * 10/2001 Schmitz ..... E01C 5/00 404/34

FOREIGN PATENT DOCUMENTS

GB 194347 A * 7/1923 ..... E01C 3/006
RU 2801481 C1 * 8/2023 ..... E01C 5/005

* cited by examiner

*Primary Examiner* — Raymond W Addie
(74) *Attorney, Agent, or Firm* — Mestechkin Law Group P.C.

(57) ABSTRACT

1. A panel system is provided that includes: a first and second panel each having a top side providing a road surface and a bottom side opposite the top side, where the bottom side contacts a ground surface, and a plurality of lateral sides. At least one of the plurality of the lateral sides of the first and second panels include a feature that interlock adjacent lateral sides of the first and second panels against vertical movement relative to each other.

10 Claims, 3 Drawing Sheets

ROAD SURFACE PANELS SYSTEMS

BACKGROUND

This patent application relates to pavement systems and more particularly preconstructed road surface panel systems.

Cast in place road surface systems are known, but they are labor intensive to install and are usually not economical on a small scale. Precast road surface systems are also known, but those are simply cast in place road surface systems made remotely and shipped to the location for installation and are similarly not economical on a small scale. Moreover, these systems are considered inefficient and create a great deal of waste in the long term. Accordingly, there is a need for pre constructed road surface panel systems that are not so limited.

SUMMARY

In one aspect a panel system is provided that includes: a first panel having a top side providing a road surface and a bottom side opposite the top side, where the bottom side contacts a ground surface, and a plurality of lateral sides; and a second panel having a top side providing a road surface and a bottom side opposite the top side, where the bottom side contacts a ground surface, and a plurality of lateral sides. At least one of the plurality of lateral sides of the first and second panels include a feature that interlock adjacent lateral sides of the first and second panels against vertical movement relative to each other.

In one embodiment, the first and second panels have a trapezoidal cross sectional shape.

In one embodiment, the first and second panels have a non-right angle parallelogram cross sectional shape.

In one embodiment, the first and second panels have lateral sides that are other than perpendicular to the top and bottom sides of the respective panels.

In one embodiment, the first and second panels have adjacent lateral sides that are configured at supplementary angles.

In one embodiment, the first and second panels have cross sectional dimensions that are essentially equal, and wherein the top side of the first panel has a length that is greater than the top side of the second panel.

In one embodiment, the panel system includes a third panel having a top side providing a road surface and a bottom side opposite the top side, wherein the bottom side contacts a ground surface, and a plurality of lateral sides, wherein the top side of the third panel has a length that is greater than the top side of the second panel, and wherein the second panel acts as a wedge against the first and third panels.

In one embodiment, the lateral sides of at least one of the first and third panels are configured to provide a drainage channel.

In one embodiment, the interlocking feature comprises at least one male and at least one female component.

In one embodiment, the interlocking feature comprises a peg.

In one embodiment, the peg is sufficiently long to stake the panels to the ground.

In one embodiment, at least one of the first, second, and third panels is preprinted with traffic signals at the top side(s) thereof.

In one embodiment, at least one of the first, second, and third panels includes a preconfigured opening for access to the ground.

In one embodiment, the panel system includes a shear member that ties the first, second, and third panels together against shear forces.

In one embodiment, the first, second, and third panels each include a conduit extending laterally therein that accepts the shear member.

DETAILED DESCRIPTION

The present application generally provides a preconstructed road surface system that is easy to install and thus suitable for small scale projects.

Figure 1:
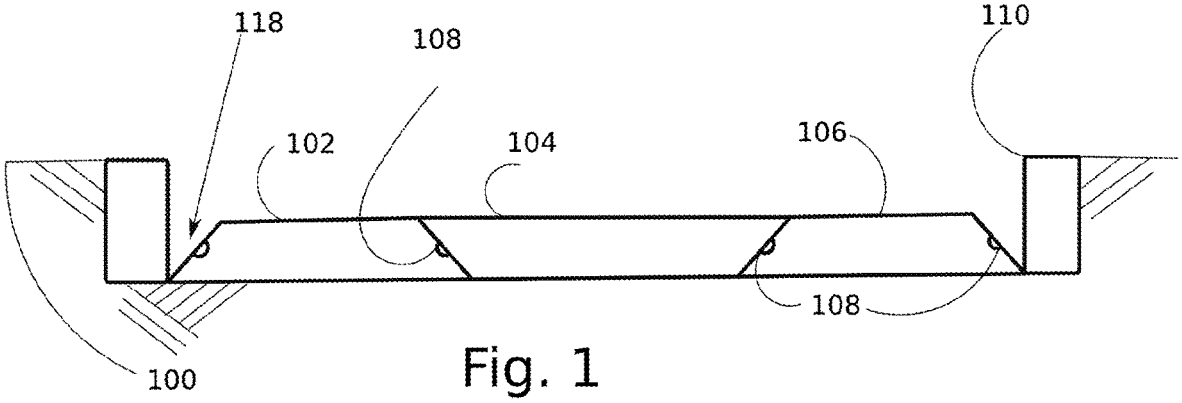
FIG. 1 is a cross sectional view of one embodiment of the preconstructed road surface system disclosed herein.

Referring to FIG. 1, the system according to one embodiment includes a plurality of precast or preconstructed panels 102, 104, 106. The panels are configured to be placed on a properly prepared ground surface 100. The ground surface 100 may include a compacted well graded gravel base or other types of bases.

The panels preferably include features 108 that interlock the panels on the adjacent sides thereof, including the lateral sides (left and right), as shown, as well as longitudinal sides (front and back). The panels 102, 104, 106 may have a rectangular cross sectional shape or preferably a trapezoidal cross sectional shape, as shown, so that a first panel 102 may be placed on the ground with the longest side of the trapezoid facing downward, followed by a second panel 104 inverted so that the opposite of the longest side of the trapezoid is facing downward, followed by a third panel 106 with the longest side of the trapezoid facing downward, etc., as shown. The lateral sides of the panels (left and right) are placed adjacent to each other and have a uniform thickness to create a level surface across all the panels. Moreover, the second or intermediate panel 104 acts as a wedge to spread and lock the other panels 102, 106 in place. The lateral sides of the panels include the features 108 that interlock the panels together. The cross sectional dimensions of the panels are preferably essentially equal so that one type of panel may be used to construct a continuous surface. By placing the panels 102, 104, 106, as shown, with the longest trapezoidal sides on the opposite ends, a recess 118 is created that may act as an open drainage channel. Finally, the system may include curbs 110 at opposite ends of the roadway.

Figure 2:
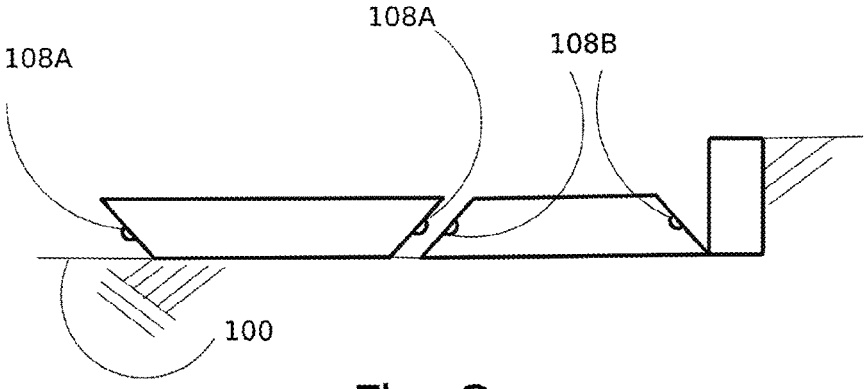
FIG. 2 is a cross sectional view of another embodiment of the preconstructed road surface system disclosed herein.
Figure 3:
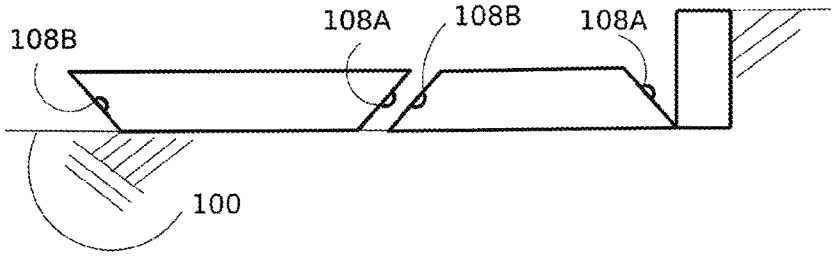
FIG. 3 is a cross sectional view of another embodiment of the preconstructed road surface system disclosed herein.

Referring to FIG. 2, the interlocking features 108 may include male 108A and female 108B components that receive the male components 108A, thereby locking the panels against vertical movement relative to each other. This system may be installed by placing a male panel with the longest trapezoidal side against the ground, followed by a female panel. The female panel may then be slid laterally so that the male component 108A is received by the female component 108B. The components 108A and 108B may be continuous tongue and groves, or repeating mortise and tenons. The panels may include one of each of the components on opposite lateral sides, as shown in FIG. 3. Installation of the system according to this or other embodiments may entail placing the outer panels 102, 106 first, followed by placing the middle panel 104.

Figure 4:
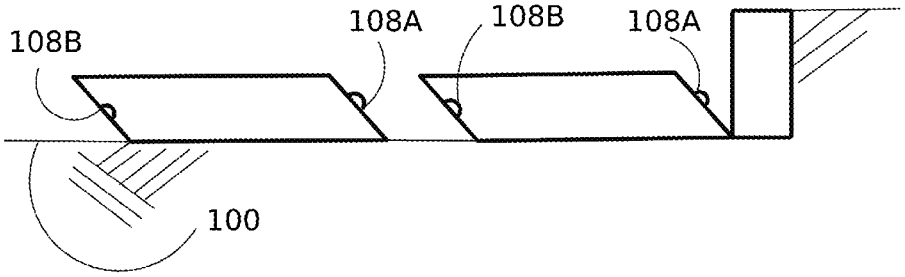
FIG. 4 is a cross sectional view of another embodiment of the preconstructed road surface system disclosed herein.
Figure 5:
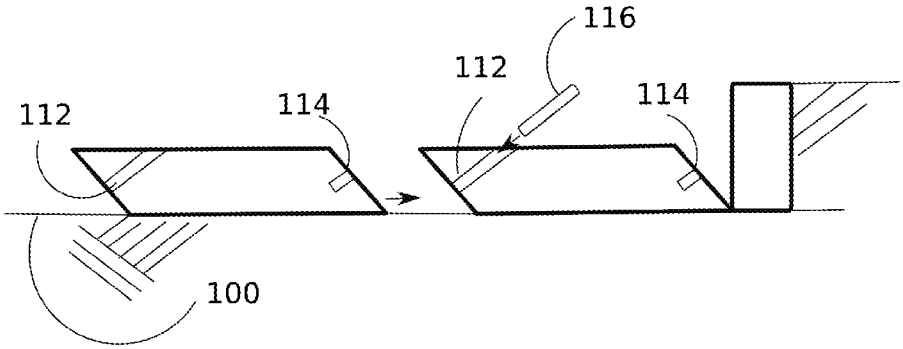
FIG. 5 is a cross sectional view of another embodiment of the preconstructed road surface system disclosed herein.

The cross sectional shape of the panels may also be parallelograms, as shown in FIGS. 4-5. In this embodiment, a trapezoidal panel may be placed first with the longest side facing the ground (as shown in FIG. 1), followed by parallelogram panels in series until the desired roadway width is achieved. Finally, the interlocking features may include a peg 116 that is fit into coincident holes 112, 114 in the panels, as shown. The pegs may be long enough to pass through both panels and stake into the ground.

The material used and the dimensions of the panels may vary for different uses. For non-vehicular uses, the panels may be made from a low strength material, such as recycled plastics, low strength concrete, etc. For vehicular uses, the panels may be constructed using a more robust material, including reinforced plastic, concrete, cast iron, etc. Similarly, the thickness of the panels may vary depending on the expected load. For example, the thickness may vary from between about 2 inches to about 6 inches. The panels may be solid throughout or may contain voids to reduce the weight and cost.

Figure 6:
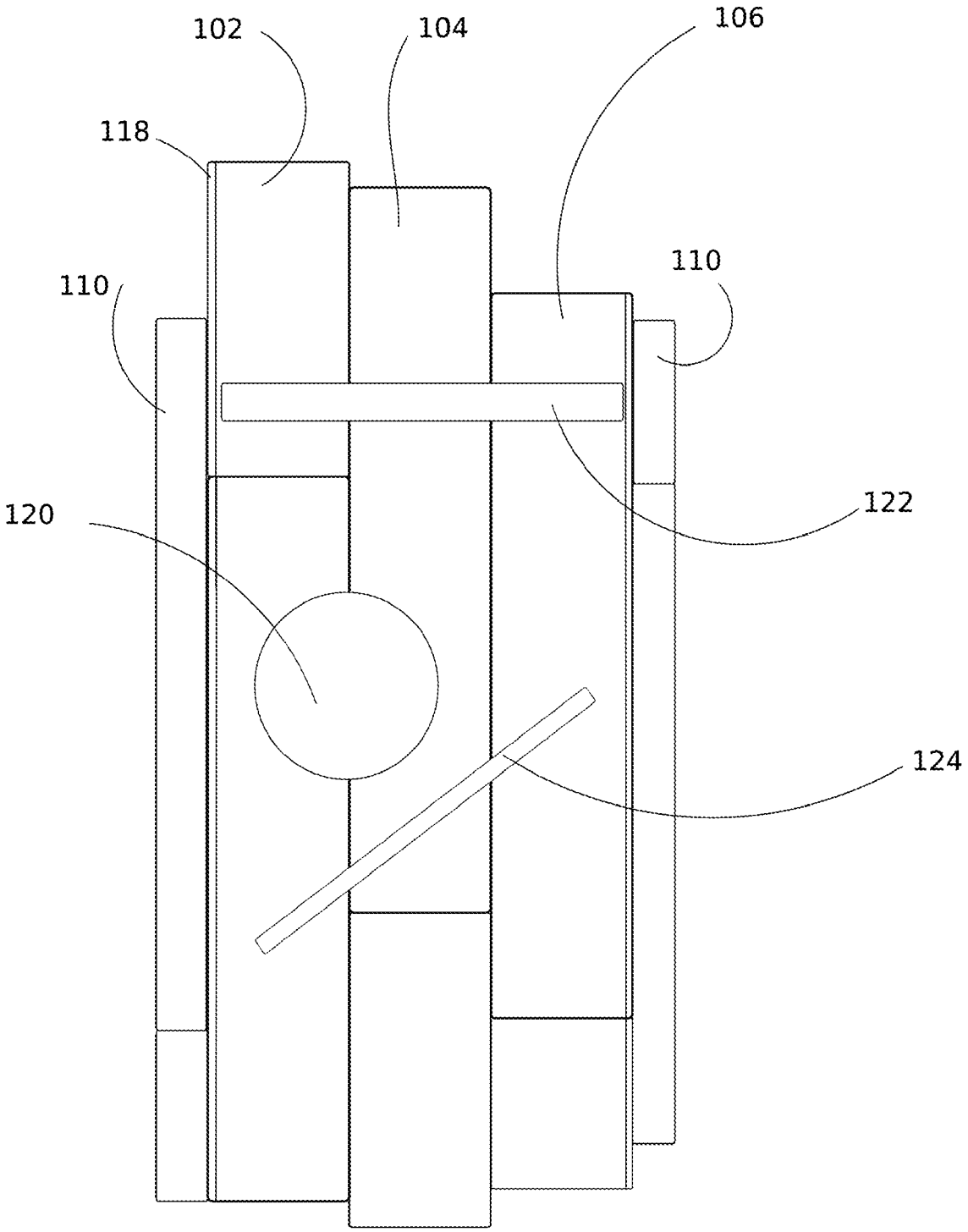
FIG. 6 is a plan view of one embodiment of the preconstructed road surface system disclosed herein.

Referring to FIG. 6, a plan view of the panel system is shown. As can be seen, panels 102, 104, 106 are placed side-by-side laterally and longitudinally. The panels are preferably staggered as shown to provide a more stable road surface. The panels 102, 104, 106 may be pre-painted or printed with lines 112 or other traffic signals. The length of the panels may vary but are preferably between about 4 feet to about 12 feet, preferably between about 6 feet and about 8 feet. The panels may include preconfigured openings with corresponding lids 120 for access to the ground or utilities underneath the panel. It can be appreciated that braking forces create shear stresses between the lateral sides of the panels, which may overly stress the interlocking members 108. In this instance, a shear member 124 may be installed that strengthens the installed panels against such shear stresses. The shear member may be a reinforcement bar, which may be sized to fit into a conduit extending laterally within the panels. The conduit may be perpendicular to the panels or preferably at a diagonal, as shown. The panels may include a plurality of conduits spaced, for example, every 12-24 inches. In addition to providing a space to receive the shear member 124, the conduits may be used for utilities, such as electrical wires.

While the foregoing has been described in some detail for purposes of clarity and understanding, it will be appreciated by one skilled in the art, from a reading of the disclosure, that various changes in form and detail can be made without departing from the true scope of the invention.

The invention claimed is:

1. A panel system comprising:

a first panel having a top side providing a road surface and a bottom side opposite the top side, wherein the bottom side contacts a ground surface, and a plurality of lateral sides, comprising a first inclined lateral side;

a second panel adjacent to the first panel, the second panel having a top side providing a road surface and a bottom side opposite the top side, wherein the bottom side contacts a ground surface, and a plurality of lateral sides comprising a second lateral side, wherein at least one of the plurality of lateral sides of the first and second panels include a feature that interlock adjacent lateral sides of the first and second panels against vertical movement relative to each other;

wherein the first and second panels have a trapezoidal cross-sectional shape, such that at first inclined lateral side and the second inclined lateral side are other than perpendicular to the top and bottom sides of the respective first and second panels and wherein the first inclined lateral side of the first panel is at an angle that is supplementary to an angle of the second inclined lateral side of the second panel, and wherein the interlocking feature comprises at least one peg extending lengthwise out from the first inclined lateral side of the first panel and configured to be received in a coincident hole in the second inclined lateral side of the second panel.

2. The panel system of claim 1, wherein the coincident hole in the second panel extends through the second panel to a hole in the top side of the second panel, and wherein the at least one peg is configured to extend through a hole in the first inclined surface of the first panel, and the coincident hole and the hole in the top side of the second panel to connect the first and second panels together.

3. The panel system of claim 1, wherein the first and second panels have a non-right angle parallelogram cross sectional shape.

4. The panel system of claim 1, comprising a shear member that ties the first, second, and third panels together against shear forces.

5. The panel system of claim 4, wherein the shear member is a rigid rod configured to slide into the conduit of each panel.

6. The panel system of claim 1, wherein the first and second panels have cross sectional dimensions that are essentially equal, and wherein the top side of the first panel has a length that is greater than the top side of the second panel.

7. The panel system of claim 6, comprising a third panel having a top side providing a road surface and a bottom side opposite the top side, wherein the bottom side contacts ground surface, and a plurality of lateral sides, wherein the top side of the third panel has a length that is greater than the top side of the second panel, and wherein the second panel acts as a wedge against the first and third panels.

8. The panel system of claim 7, wherein lateral sides of at least one of the first and third panels are configured to provide a drainage channel.

9. The panel system of claim 1, wherein the peg is sufficiently long to stake the panels to the ground.

10. The panel system of claim 1, wherein the first, second, and third panels each include a conduit extending diagonally therein that accepts the shear member.

* * * * *